US011426647B2

(12) United States Patent
Wariakois et al.

(10) Patent No.: US 11,426,647 B2
(45) Date of Patent: Aug. 30, 2022

(54) SPLITBOARD BINDING SYSTEM WITH SIDE MOUNTING LOCKING TOURING BRACKET

(71) Applicant: Voile Manufacturing, Salt Lake City, UT (US)

(72) Inventors: Mark Wariakois, Salt Lake City, UT (US); Eric Christensen, Salt Lake City, UT (US)

(73) Assignee: Voile Manufacturing, Salt Lake City, UT (US)

( * ) Notice: Subject to any disclaimer, the term of this patent is extended or adjusted under 35 U.S.C. 154(b) by 0 days.

(21) Appl. No.: 17/039,652

(22) Filed: Sep. 30, 2020

(65) Prior Publication Data

US 2021/0093943 A1 Apr. 1, 2021

Related U.S. Application Data

(60) Provisional application No. 62/908,347, filed on Sep. 30, 2019.

(51) Int. Cl.

| | |
|---|---|
| ***A63C 10/08*** | (2012.01) |
| ***A63C 10/14*** | (2012.01) |
| *A63C 5/02* | (2006.01) |

(52) U.S. Cl.

CPC ..... *A63C 10/08* (2013.01); *A63C 10/14* (2013.01); *A63C 5/02* (2013.01)

(58) Field of Classification Search

CPC ..... A63C 10/08; A63C 10/14; A63C 5/02; A63C 2203/06

See application file for complete search history.

(56) References Cited

U.S. PATENT DOCUMENTS

| | | | | |
|---|---|---|---|---|
| 5,984,324 | A * | 11/1999 | Wariakois | A63C 5/03 280/14.24 |
| 7,823,905 | B2 | 11/2010 | Ritter | |
| 8,226,109 | B2 | 7/2012 | Ritter | |
| 8,764,043 | B2 | 7/2014 | Neubauer et al. | |
| 9,022,412 | B2 | 5/2015 | Ritter | |
| 9,126,099 | B2 | 9/2015 | Ritter | |
| 9,220,968 | B2 | 12/2015 | Ritter | |
| 9,573,043 | B2 | 2/2017 | Ritter | |
| 9,782,664 | B1 * | 10/2017 | Ritter | A63C 10/06 |
| 9,827,481 | B2 | 11/2017 | Ritter | |
| 9,833,686 | B2 | 12/2017 | Ritter | |
| 10,035,058 | B1 * | 7/2018 | Ritter | A63C 9/0807 |

(Continued)

*Primary Examiner* — Brian L Swenson

(74) *Attorney, Agent, or Firm* — Bretton L. Crockett; TechLaw Ventures, PPLC

(57) ABSTRACT

Splitboard binding systems including a binding that may be attached to either a left or right gliding board in a ski mode or to both gliding boards in a snowboard mode. The binding includes left and right bottom rails attached to the bottom surface of a base plate, which define channels for slidable attachment to "pucks" disposed on the gliding board in snowboard mode. Each rail has a circular bore at a forward end for attachment to a counterpart pivot pin on a ski mode toe bracket in a ski mode by a sideways movement. A securing lever is disposed on an upper surface of the toe bracket. When the securing lever is rotated into a securing position, an end of the securing lever prevents removal of the pivot pin from the rail bore. Rotating the securing lever to a removal position allows the binding to be removed.

21 Claims, 8 Drawing Sheets

(56) References Cited

U.S. PATENT DOCUMENTS

| | | | | |
|---|---|---|---|---|
| 10,092,816 | B2 | 10/2018 | Ritter | |
| 10,350,588 | B2 | 7/2019 | Kaneko et al. | |
| 10,814,210 | B2 | 10/2020 | Ritter | |
| 2013/0341889 | A1* | 12/2013 | Neubauer | A63C 10/16<br>280/607 |
| 2014/0210187 | A1* | 7/2014 | Ritter | A63C 10/20<br>280/611 |
| 2015/0343298 | A1* | 12/2015 | Ritter | A63C 10/12<br>280/11.31 |
| 2017/0189788 | A1* | 7/2017 | Wariakois | A63C 10/14 |
| 2019/0224560 | A1* | 7/2019 | Ritter | A63C 9/0847 |

* cited by examiner

SPLITBOARD BINDING SYSTEM WITH SIDE MOUNTING LOCKING TOURING BRACKET

CROSS-REFERENCE TO RELATED APPLICATION

This application claims the benefit of U.S. Provisional Application No. 62/908,347, filed Sep. 30, 2019, which is incorporated herein by reference in its entirety, including but not limited to those portions that specifically appear hereinafter.

TECHNICAL FIELD

This invention relates to ski equipment, and specifically relates to an improved boot binding system for use with splitboards.

BACKGROUND

Snowboarding is a very popular winter recreational sport that was developed in the 1980's. The more commonly used snowboards are structured as a single board having binding assemblies attached to the board for receiving the boots of the snowboarder (also referred to herein as the "rider").

Another popular form of snowboarding involves the use of what is known as a splitboard, which comprises two separate and conjoinable boards. When separated, the two boards are skis; when conjoined together, the boards form a snowboard. Splitboards provide the user with the alternative of using the skis in a traditional skiing mode or joining the skis for use as a snowboard. The dual configuration of splitboards is particularly useful for using the separate skis for alpine touring into a desired area, then joining the skis into the snowboard configuration to snowboard down a terrain.

U.S. Pat. No. 5,984,324, the contents of which are incorporated herein by reference, discloses a splitboard binding assembly that has become essentially the industry standard for attachment of boot bindings between the skiing and the snowboarding modes of a splitboard. That is, splitboards are provided with a boot binding assembly that secures the boot to the board along its longitudinal axis when in the skiing mode, and is also provided with a boot binding assembly for the snowboarding mode that comprises a pair of toe pucks attached to one ski and a pair of heel pucks attached to the other ski. When the two skis are positioned side-by-side and secured together for use in the snowboarding mode, each toe puck aligns with a respectively positioned heel puck, and a boot binding is then slid onto an aligned heel and toe puck so that the boot binding spans the two skis.

The '324 patent discloses an exemplary snowboard binding arrangement that comprises a slider plate formed with sides that are curved to form a U-shaped channel on either side of the slider plate. The U-shaped channels are sized to be received on laterally extending flanges on the aligned heel and toe pucks. When the slider plate of the binding is fully engaged on the heel and toe puck, a pin is positioned through holes formed in the forward end of the slider plate to secure the slider plate relative to the heel and toe pucks.

U.S. Pat. Nos. 9,126,099, 9,573,043 and 10,350,588, the contents of each of which, are specifically incorporated herein by reference in their entireties, also discloses a splitboard binding that uses a single toe latch pedal mechanism to secure binding into either the snowboard or ski mode. Such assemblages require a plurality of specialized parts, with an increased manufacturing cost, and are more susceptible to freezing and jamming by snow or ice than simpler designs.

U.S. Pat. No. 8,764,043, the contents of which are specifically incorporated herein by reference, discloses a splitboard binding that eliminates the need for a locking mechanism on the toe for ski mode attachment, by using a circular hook portion that engages with a circular channel on a toe bracket attached to the gliding board, that only engage or disengage at a predetermined angle in excess of one reached during use.

Bindings or binding systems that which are simple to use and easy to operate under harsh conditions would be an improvement in the art.

SUMMARY

The present disclosure is directed to splitboard bindings systems that includes a binding that may be attached to either a left or right gliding board in a ski mode or to both the left and right gliding board in a snowboard mode. The binding may include left and right bottom rails attached to the bottom surface of a base plate. The rails and base plate define channels for slidable attachment to "pucks" disposed on the gliding board in snowboard mode. Each of the left and right rails has a circular bore at a forward end for attachment to a counterpart pivot pin on a ski mode toe bracket in a ski mode by a sideways movement. A securing lever is disposed on an upper surface of the toe bracket. When the securing lever is rotated into a securing position, an end of the securing lever prevents removal of the pivot pin from the rail bore. Rotating the securing lever to a removal position allows the binding to be removed.

The assemblies may further include a rear sliding lock positioned on the left or right board near the rear of the binding which may be used to secure the heel of the binding where desired.

DESCRIPTION OF THE DRAWINGS

It will be appreciated by those of ordinary skill in the art that the various drawings are for illustrative purposes only. The nature of the present disclosure, as well as other embodiments in accordance with this disclosure, may be more clearly understood by reference to the following detailed description, to the appended claims, and to the several drawings.

DETAILED DESCRIPTION

The present disclosure relates to apparatus, systems, and methods for snowboard and splitboard bindings. It will be appreciated by those skilled in the art that the embodiments herein described, while illustrative, are not intended to so limit this disclosure or the scope of the appended claims. Those skilled in the art will also understand that various combinations or modifications of the embodiments presented herein can be made without departing from the scope of this disclosure. All such alternate embodiments are within the scope of the present disclosure.

Figure 1:
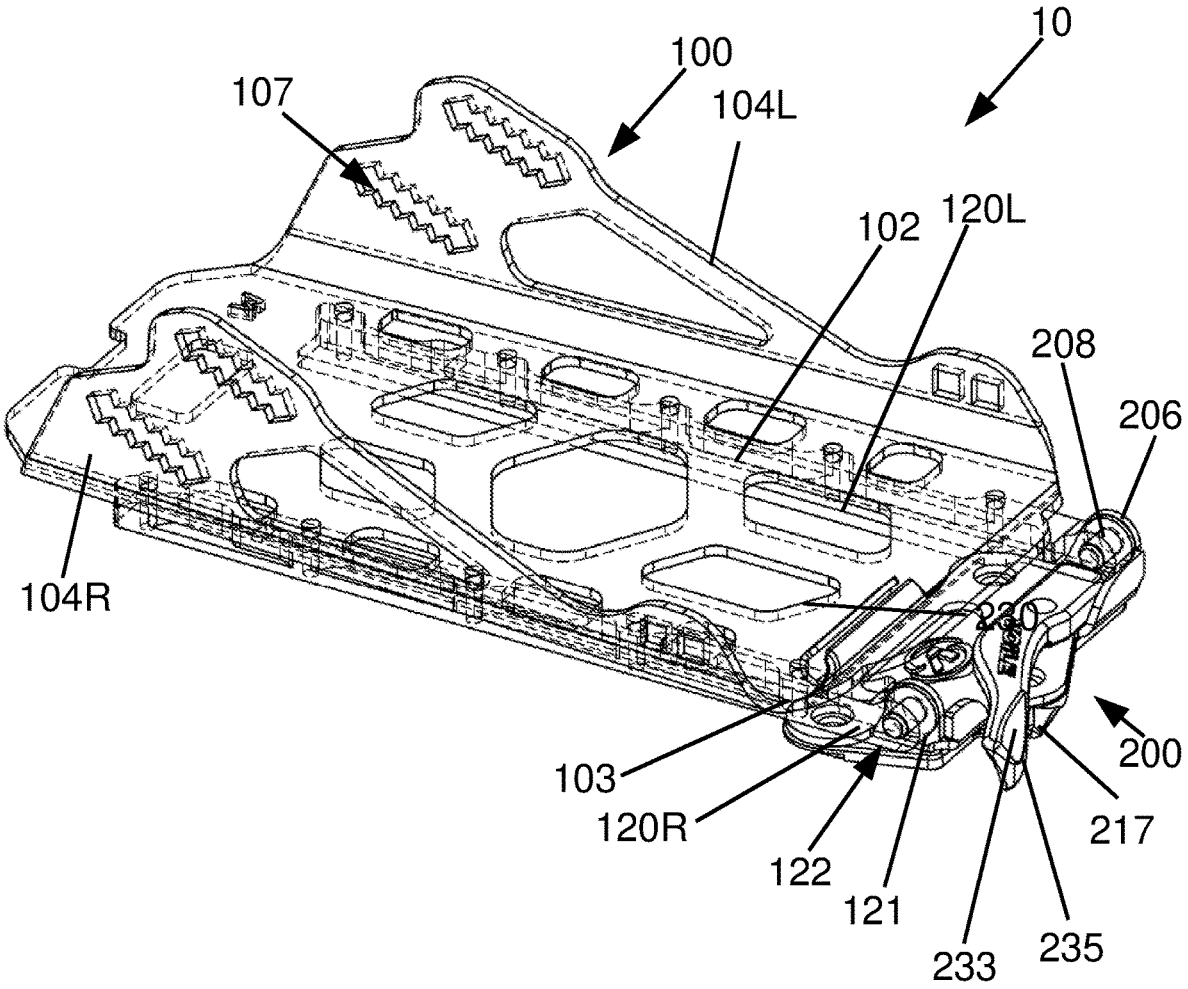
FIG. 1 depicts a perspective view of a splitboard binding system in accordance with the present disclosure in position on a splitboard in a skiing confirmation.

Turning to FIG. 1, a first embodiment of a splitboard binding system 10 in accordance with this disclosure is depicted. The binding system 10 includes a binding 100 and a toe bracket 200. The binding 100 is depicted in dashed lines in FIG. 1 and in isolation in FIG. 3, and may be attached to either a left or right gliding board of a splitboard in a ski mode or to both the left and right gliding board in a snowboard mode. It will be appreciated that in a typical installation two bindings 100 will be used with a single splitboard assembly. Binding 100 may include a base plate 102, which has a generally planar upper surface 101 for receiving a user's foot, typically in a snow boot, and a corresponding planar lower surface 103. A number of openings 105 may be formed in the planar section to reduce the weight of the binding 10 and allow any snow on the sole of a user's boot to pass therethrough in use.

At either side surface of the planar section, a sidewall 104L or 104R may be disposed as a generally orthogonal wall. Where present, the sidewalls 104L or 104R may contain strap openings 107, allowing for connection to securing straps or other securing structures to retain a user's foot in the binding 100. It will be appreciated that the planar section may include different openings or structures for connection to other types of securing features for use as a plate-type binding or a strap-type binding. For example, a highback may be attached using a rear strap.

Left and right bottom rails 120L and 120R are attached to the bottom surface 103 of the base plate 102. Each of the left and right bottom rails 120L or 120R has a rounded forward end 121 with a circular bore 122 disposed therethrough at a generally orthogonal angle to a long axis of the rail, to serve as a pivoting attachment point to a toe bracket 200 in a ski mode. The bores 122 allow the binding 100 to attach to the separated members of the gliding board for ski mode attachment, as depicted in FIGS. 1, 4A, 4B and 4C, as discussed further herein.

As depicted, each bottom rail 120L or 120R may be formed as an elongated member that defines a channel in connection with the bottom surface 103 of the base plate 102. For use in snowboard or glide mode, the two halves of the splitboard are joined together, and the bindings 102 secured thereto, as disclosed in Applicant's prior U.S. Pat. No. 9,884,243, the contents of which are specifically incorporated herein by reference. Such channels may be open at the rear end of the binding 100 and additional structures and features may be present to facilitate sliding placement on the pucks and securement thereto, as by use of a heel locking securing lever. It will be appreciated that other mechanisms for attaching to the splitboard in a snowboard conformation, or for securement in such a position may be used. Each bottom rail 120 may further include connection structures allowing it to be connected to the base plate 100. In the depicted embodiment, these include screw holes 130.

Figure 2A:
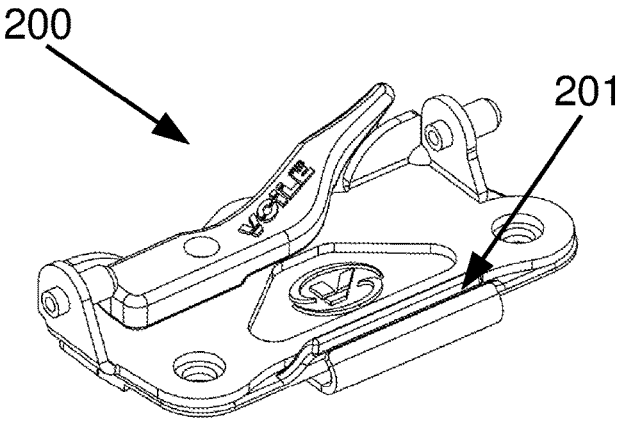
FIG. 2A depicts a rear perspective view of a toe bracket for the splitboard binding assembly of FIG. 1.
Figure 2B:
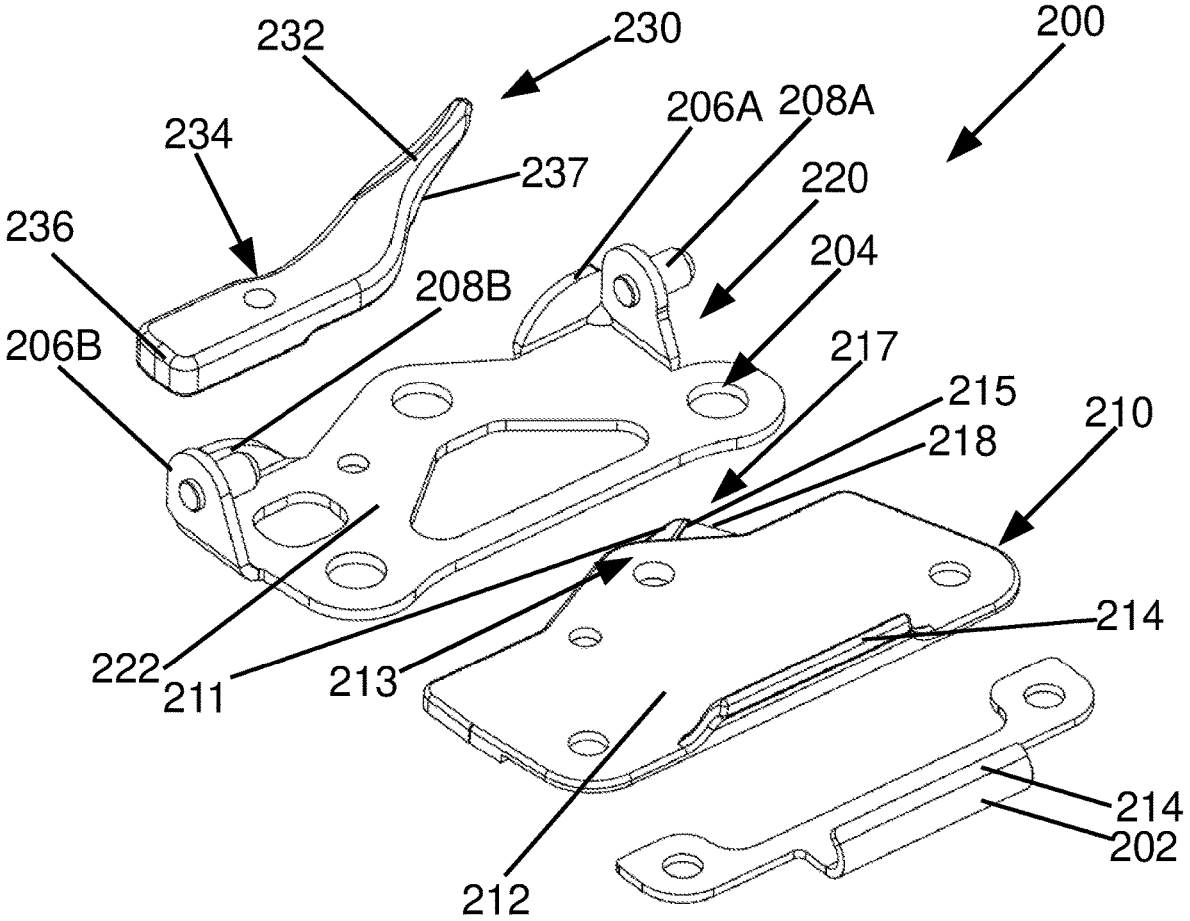
FIG. 2B depicts a rear perspective exploded view of some of the components of the toe bracket of FIGS. 1 and 2A.

Turning to FIGS. 2A and 2B, the components of the toe bracket 200 depicted in FIG. 1 are depicted in isolation, in assembled and exploded views. As depicted, along a rear surface, a crampon attachment clip 201, may be formed as a bore having an alignment that is generally orthogonal to an axis of the ski member and binding (on installation), with an upper slot opening into the curved bore. A rotation axle on a crampon, can be inserted therein to provide a pivot point for a crampon placed under the binding. The toe bracket 200 may include a base plate 210 generally formed as a member to which the remaining portions of the bracket 200 are attached, and a rear curved portion 214 thereon may define the forward edge of the opening of the crampon attachment clip 201. An underlying crampon attachment member 202 may reside at least partially under the base plate 210 and have a rear curved portion 204 that rises to form the body of the crampon clip 201.

The base plate 210 may have a planar lower surface for contacting the upper surface of the gliding member, with a recess for the crampon attachment member 202. The base plate 210 may further include a planar upper surface 212 spaced apart from the planar lower surface. At a forward edge, a generally triangular portion 213 may extend forwardly defining the front edge. A lever securing lock 217 may be formed as an extension of the base plate 210 that extends forwards of the front edge along one side of the triangular portion 213, as a portion having a reduced height and a with a slanted front surface 211 that may be formed as a wedge tapering from the front edge to a ridge 215 having a generally vertical rear wall 216 (FIG. 5C) above a recessed portion with a lower floor 218.

A connection member 220 may be formed as a body having a generally planar central portion 222 with generally flat lower and upper surfaces and two pivot supports 206A and 206B disposed at the front upper corners. As depicted, each pivot support may include a transverse member and a connected front member, each connected to the adjacent edge of the planar central portion and joined to one another. For example, where the connection member 220 is formed of a steel alloy, the transverse and front members may be formed by bending tabs to the correct position and then welded to one another.

Pivot pins 208A and 208B are disposed on each of the pivot supports, 206A and 206B. As depicted, each extends in the same direction orthogonal to the long axis of the gliding member on which the toe bracket 200 is installed. In the depicted embodiment, they extend in the right-hand direction, but it will be appreciated that on other embodiment, it may be the opposite direction. Additionally, as depicted, the pivot pins 208A and 208B are in coaxial alignment.

In some exemplary embodiments, the pivot pins 208A and 208B and pivot supports 206A and 206B may be constructed from like materials, such as the same grade of stainless steel, which are joined to one another using a suitable process. For example, in some embodiments, the pivot pines may be welded to the pivot supports. In other exemplary embodiments, the pivot pins 208 may be formed to allow them to be joined to the supports similar to a rivet, as shown in FIG. 2A with the depicted tubular "heads" at the connection points. The pivot pins may be attached prior to, or during, the positioning of the pivot supports by bending of the connection member, where appropriate. The entirety of the connection member 220 may be formed from a single such material, using suitable methods, such as welding, binding and the like or by casting as a unitary member. This results in a stronger structure and helps to eliminate the issue of the pins wobbling, which is a known issue with press fit pins of differing materials used on the end of the rails in the commercially available versions of the step-in latching bindings of U.S. Pat. Nos. 9,126,099, 9,573,043 and 10,350,588.

A securing lever 230 may have a pivot point 234, such as a hole for attachment to an axle or pivot that extends upwards vertically from the base plate 210 through the connection member. In one embodiment, the axle may be a threaded shaft that screws into a recess in the base plate and has a nut placed thereon to retain the securing lever. A handle portion 232 extends from one side of the pivot point at an angle generally in the same direction as the pivots 208A and 208B and forwards to a connection structure 233.

In the depicted embodiment, the connection structure 233 may be a portion at a lower side of the handle portion nearer the distal end, which has a flat front surface 235 (FIG. 1) and a tapered rear surface leading to a thinner lower edge 237. As best depicted in FIG. 5C, the recessed rear surface may be configured to form a gripping area or fingerhold for actuating the securing lever 230. As depicted, the fingerhold may be formed as a recessed area 247 of the rear surface disposed under an upper thicker region 249 which the finger(s) of a user can articulate against. The portion of lower edge 237 passing over the lever securing lock 217 may be recessed as shown by notch 239 (FIG. 5C).

A locking end 236 may be a generally flat end surface that is wider than the pivot pin 208B defining the end of the portion of the lever extending from pivot point 234 toward the pivot pin 208A that extends into the body of the toe bracket 200, in the secured position. As depicted, the locking end 236 may reside adjacent, but slightly below the pin 208B.

Securing lever 230 may thus have an angled paddle shape from the locking end to the connection structure on the handle portion. When the securing lever 230 is rotated to the secured position (as in FIGS. 1, 5A and 5D), the locking end 236 is moved adjacent the pivot pin 208B and the handle portion 232 moves adjacent the front edge, such that the connection structure 233 passes over the lever securing lock 217. As it passes, the notch 247 passes over the slanted front surface 211. Where the securing lever 230 and/or the base plate 210 are constructed from at least partially resilient polymeric materials the securing lever 230 is ramped upwards over the tapered front surface 211 and ridge 215 and "pops" into the locked secured position over the recessed portion 218. The securing lever 230 is retained therein by an interference fit between the flat front surface 235 of the connection structure 233 and the flat rear surface 216 of the ridge 215. Currently, a friction resistant plastic material having properties that allow for a long wear resistance is preferred for the securing lever and base plate locking portions.

For release, a user may lift the handle portion 232 upwards, flexing the securing portion 233 away from the ridge 215, allowing the rotation to be reversed to move the lever 230 back over the ridge 215 and in the opposite direction, to pivot the locking end 236 away from the pivot pin 208B. Where, as best illustrated FIG. 5C, the recessed rear surface is configured to form a gripping area or fingerhold 247 for actuating the securing lever 230, the user may utilize this area to grip lever for lifting. It will be appreciated that where the securing lever is constructed from at least partially resilient polymeric materials, the resilient nature of the materials may aid in the flexion for release.

Figure 3:
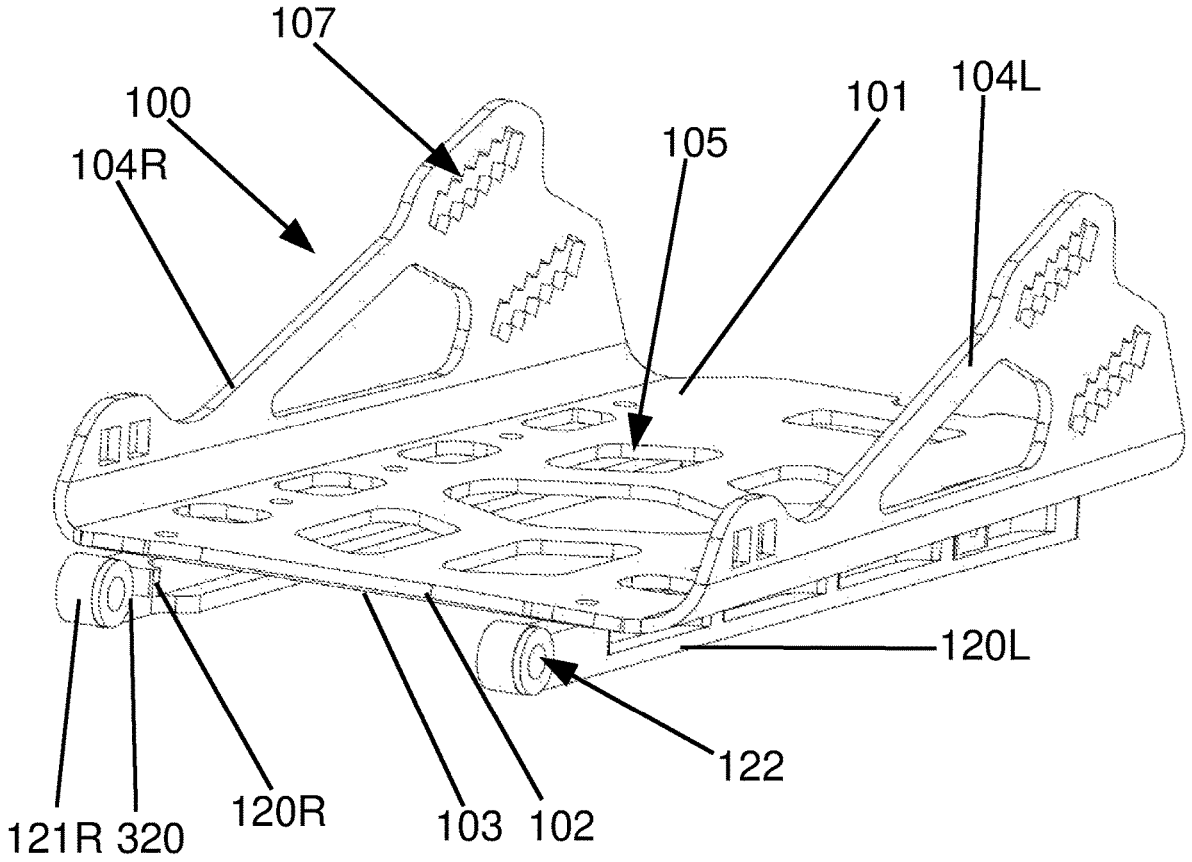
FIG. 3 is a front perspective view of the front portion of the binding of the binding system shown in FIGS. 1 and 1A.
Figure 5A:
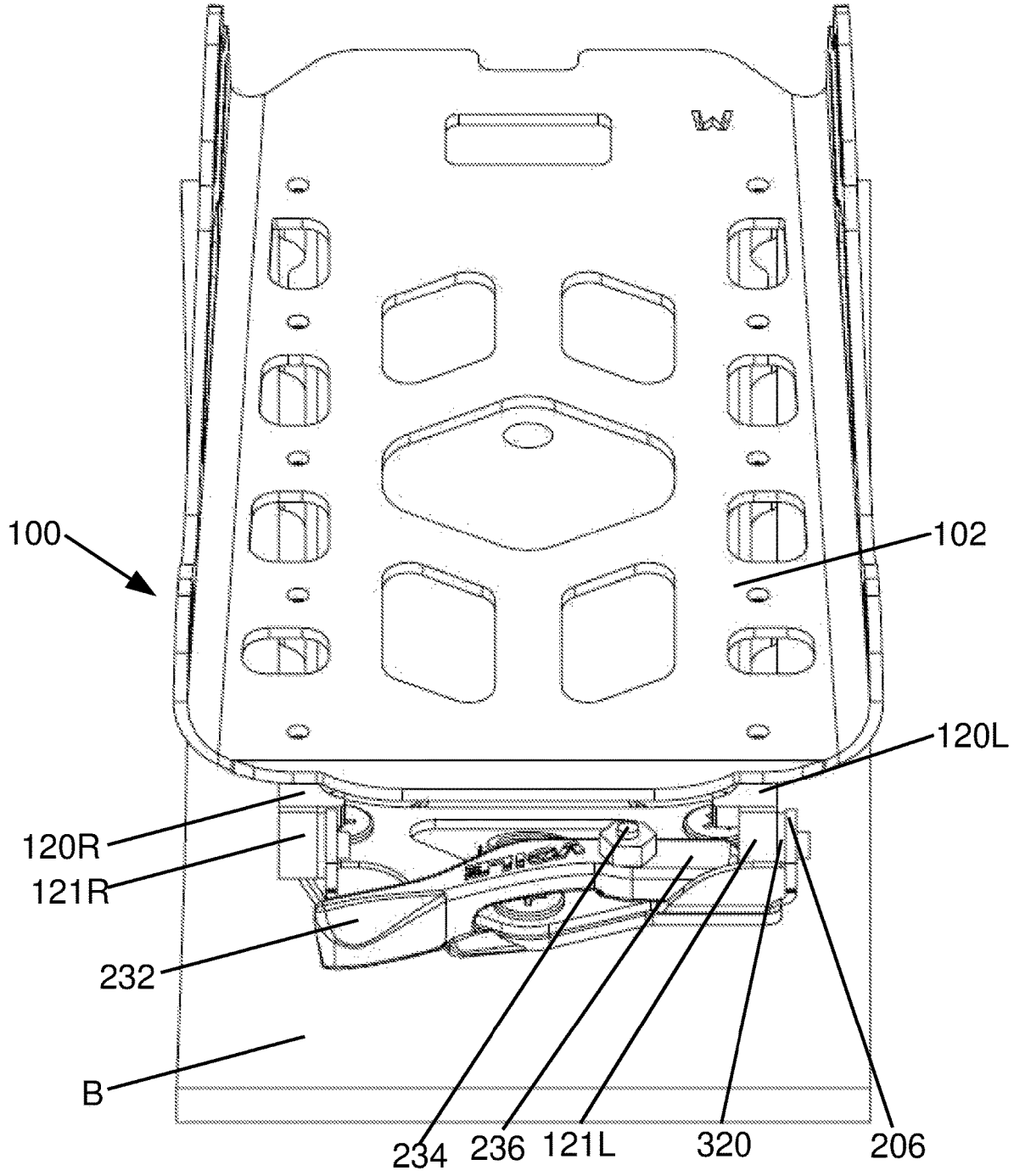
FIGS. 5A and 5B are top perspective views of a front portion of the binding system of FIG. 1 on a splitboard in a skiing confirmation with the securing lever and binding in a secured and unsecured position.
Figure 5B:
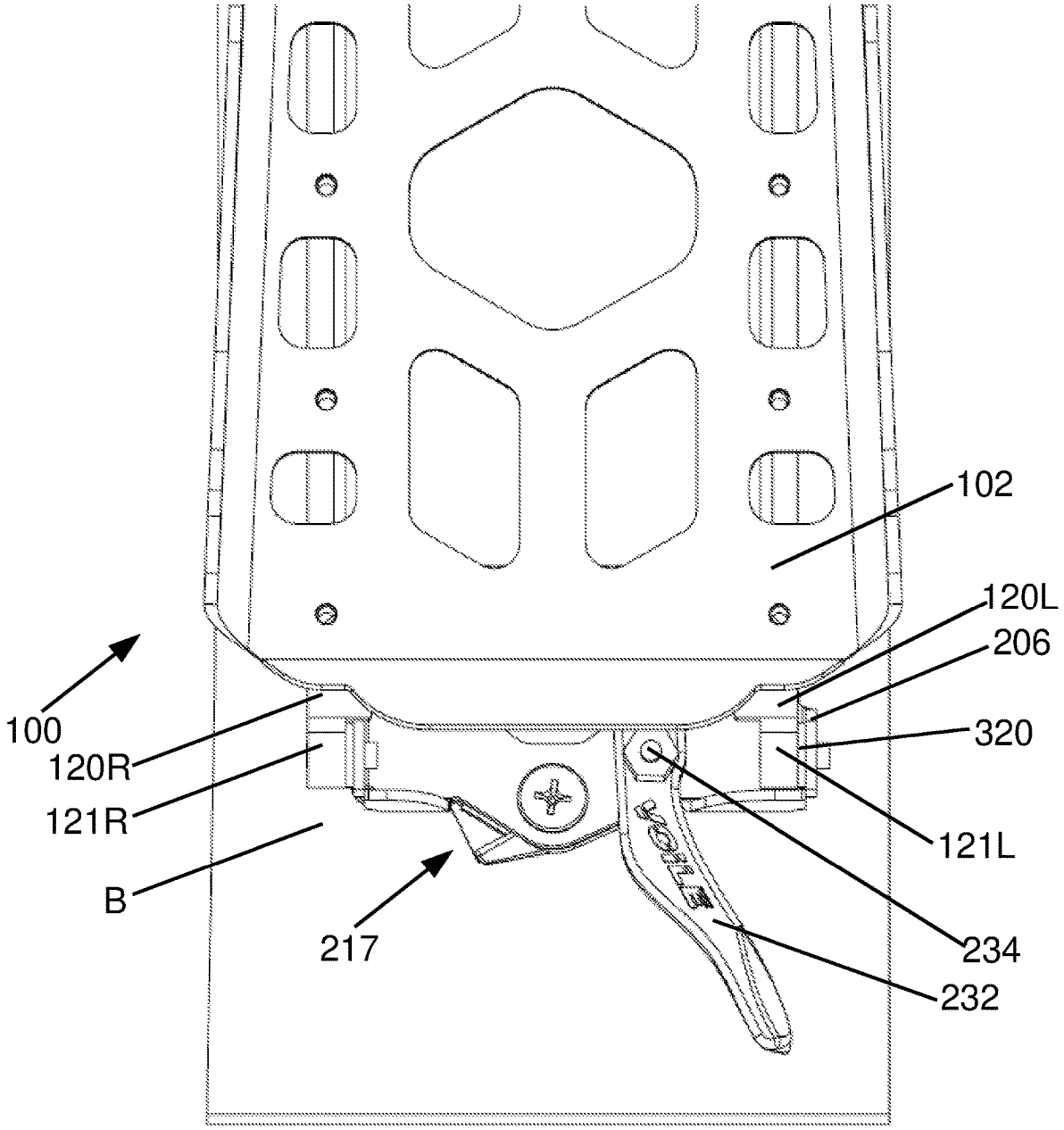
Figure 5C:
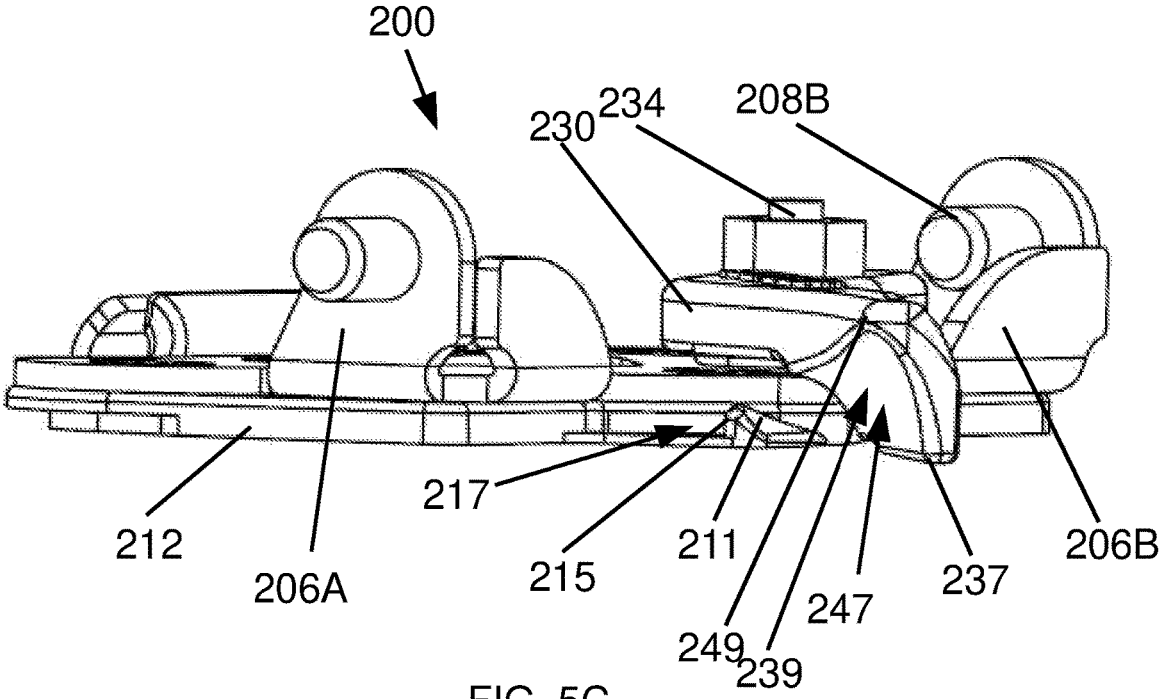
FIGS. 5C and 5D are enlarged side perspective views of the toe bracket of FIGS. 1 through 2B with the securing lever in an unsecured and a secured position.

FIG. 3 depicts the front portion of binding 100 in isolation and FIGS. 5A and 5B depict it disposed in position on a toe bracket 200, in a secured and in an unsecured position. Each of left and right bottom rails 120L and 120R extend forward of the front edge of base plate 102. The rounded forward end 121 and circular bore 122 disposed therethrough at a generally orthogonal angle to a long axis of the rail are visible. As depicted, each bore 122 may be lined with a bushing or sleeve 320 that provides a suitable surface for the rotation. In the depicted embodiment, the bushings have a sleeve portion and a flat face. As depicted in FIGS. 5A and 5B, when the binding 100 is placed in the connection position with the bores 120 over the pivot pins 208 of the bracket, the sleeve portion of the bushings 320 contacts the pin 208 and the flat face contacts the connection structure near the base of the pin to provide a flat bearing surface, at the pivoting attachment point in ski mode.

In a typical construction, the binding plate and rails may be formed from relatively lightweight materials, such as aluminum alloys, to reduce weight, while the connection member and pivot pin are constructed from materials that are selected to provide suitable strength as the binding pivots in the ski mode, bearing the weight of a user. The bushing or sleeves may be constructed from appropriate materials to provide a durable bearing surface to protect the lighter weight material from wear and be compatible with the rail and the pivot pin. For example, a brass alloy may be used.

Figure 4:
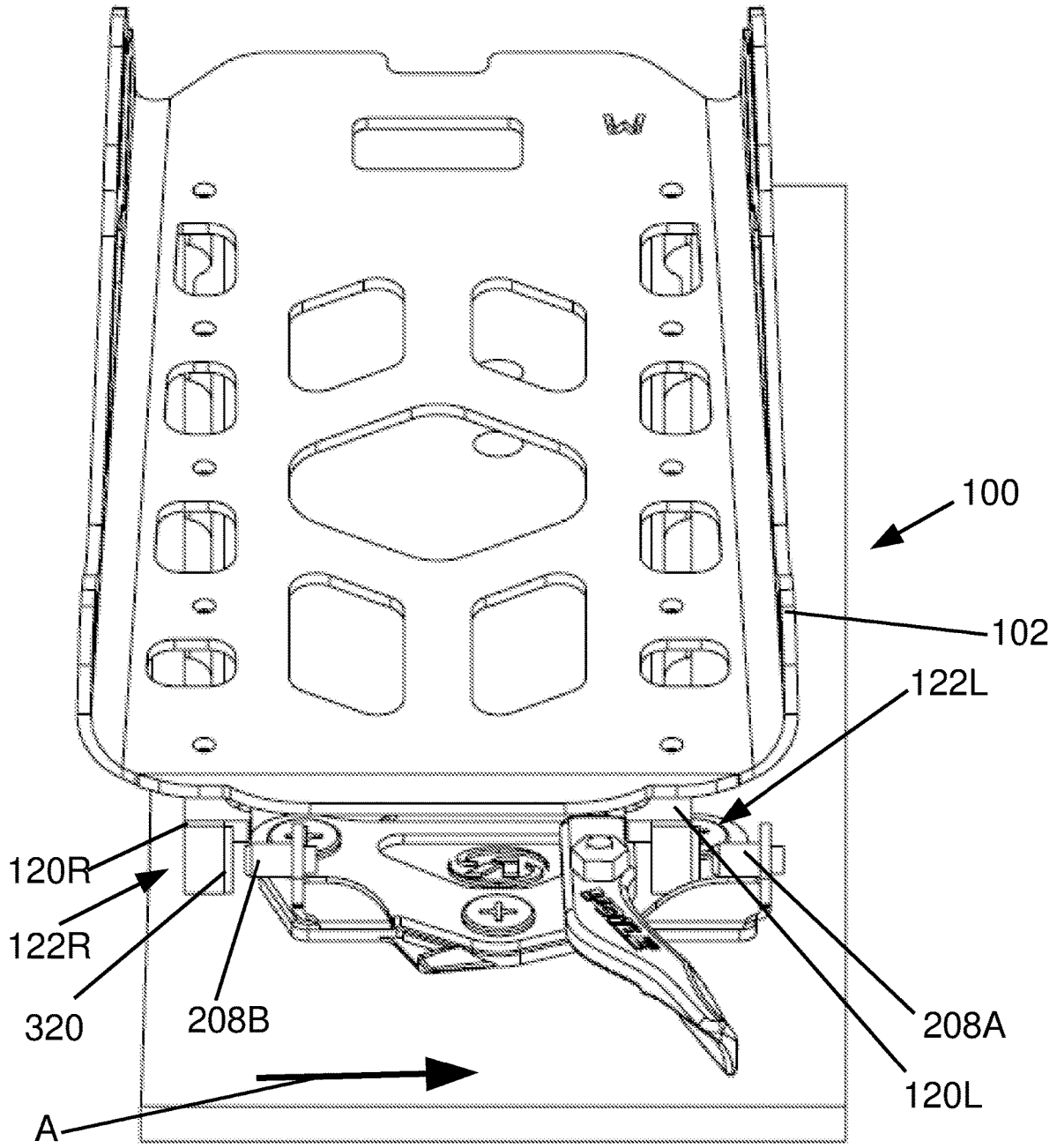
FIG. 4 is a top front perspective view of the binding system of FIG. 1 on a splitboard with the binding in position for placement on the toe bracket.

As depicted, in FIG. 4, the binding 100 may be attached to the toe bracket 200 by aligning the bores 122L and 122R with the pivot pins 208A and 208B and then moved sideways in the direction indicated by arrow A to place the bores 122L and 122R of the rails 120R and 120L on the pivot pins 208B and 208A.

Figure 5D:
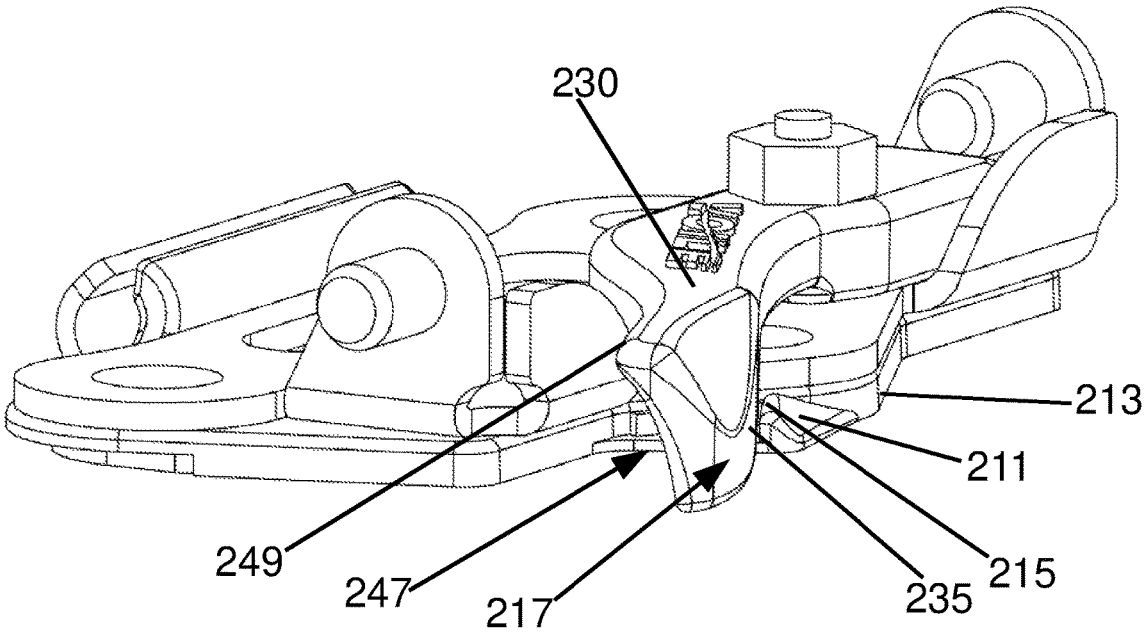

As depicted in FIGS. 5A and 5B, the binding 100 may then be secured in position, by rotating the securing lever 230 to the secured position. The unsecured and secured positions of the securing lever 230 on toe bracket 200 are illustrated in FIGS. 5C and 5D. As discussed previously herein, the locking end 236 is moved adjacent the pivot pin 208B and the handle portion 232 moves adjacent the front edge, such that the connection structure 233 ramps upwards over the ridge 215 to pass over the lever securing lock 217 and the securing lever 230 moves into the locked secured position, retained therein with the flat front surface 233 against the rear wall of the ridge 215. The locking end 236 moves to a position adjacent to the pivot pin 208B, on the opposite side of the forward portion of the railing, preventing the binding 100 from moving in the opposite direction. A user may then place the foot on the upper surface 101 of the planar member 102 and secure it thereto, as by straps. The binding 100 then may rotate on an axis defied by the pivot pins 208A and 208B with the heel free for use in ski mode.

For removal, the securing lever 230 may be rotated to the unsecured position, as depicted in FIG. 5B, with the locking end 236 moved away from the pivot pin, 208B, and allowing the binding 100 to be moved sideways for detachment from the toe bracket. To accomplish this, a user must lift the handle portion 232 upwards, flexing the securing portion 233 away from the ridge 215, in order to reverse the rotation and move the lever 230 back over the ridge 215 and moved in the opposite direction, to pivot the locking end 236 away from the pivot pin 208B.

In will be appreciated that the ability to secure the bindings 100 to the board may be useful to riders for storage, transport, and securing while making adjustments to the board during use. Systems in accordance with the present disclosure require two separate actions by a user to "unlock" the binding before it can be slidably released from the pivot pins. This reduces the likelihood of a binding becoming unsecured when not desired, due to movement during transport or adjustment.

Figure 6A:
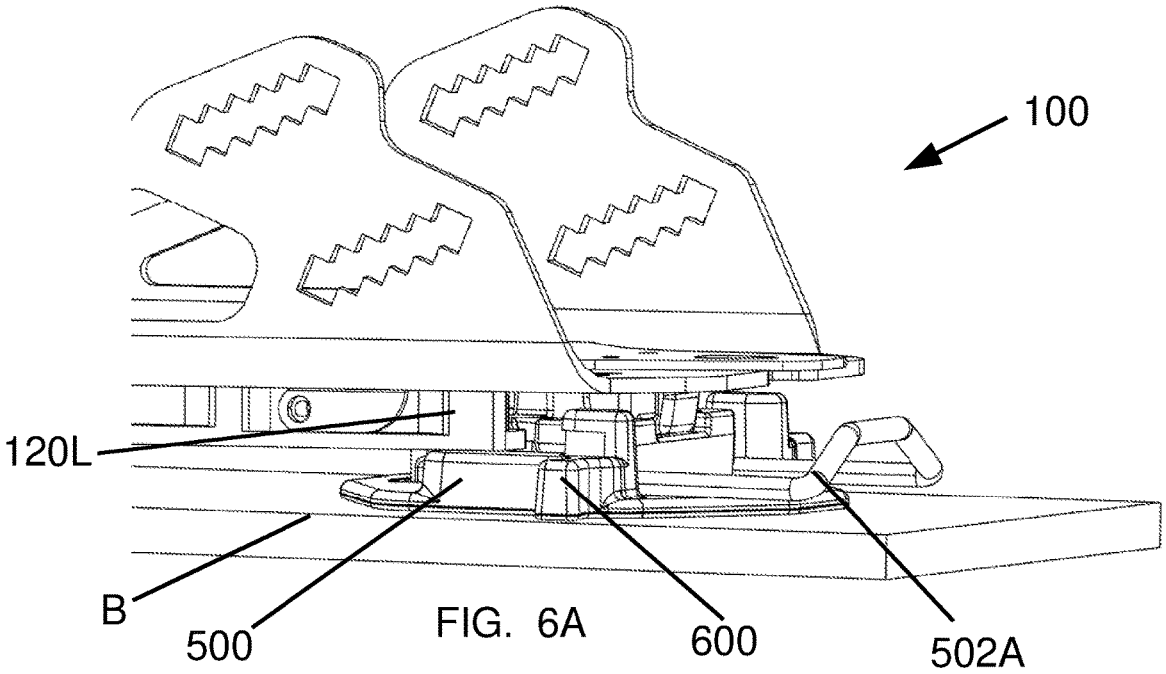
FIGS. 6A and 6B are rear side perspective views of the heel bracket and sliding heel lock assembly of FIG. 1 in position with the bottom rails of the binding assembly.
Figure 6B:
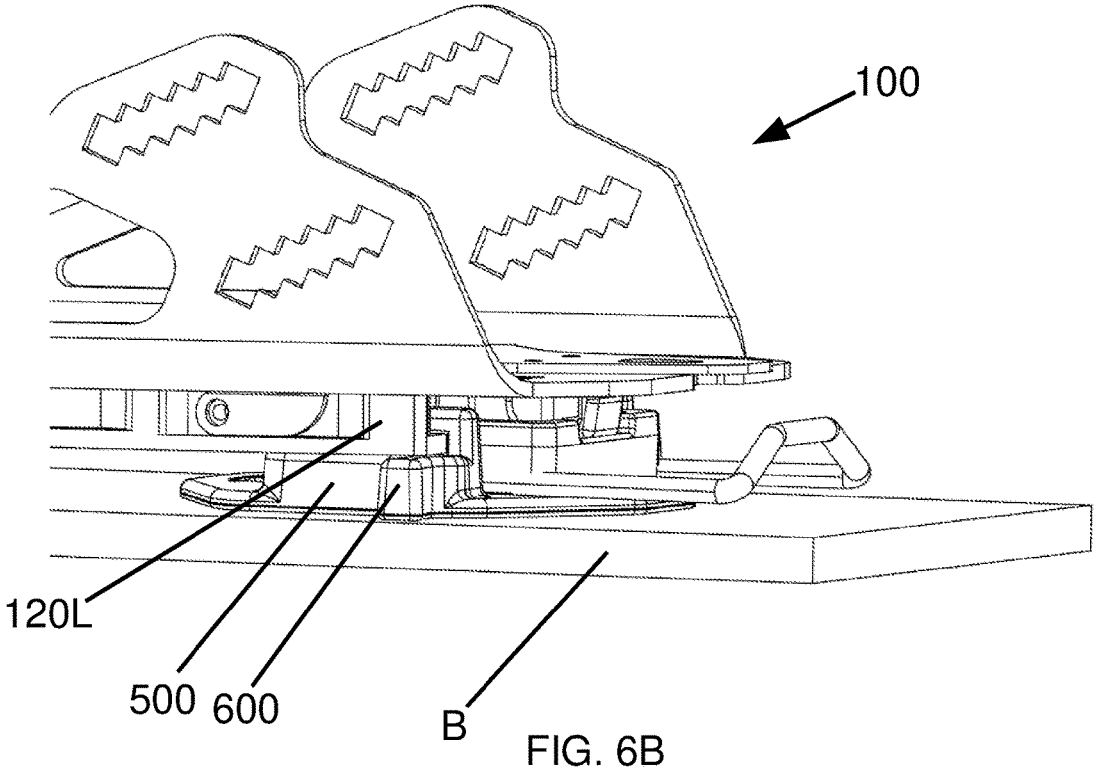

As further depicted in FIG. 6A, during use in the "free heel" mode, the rear portion of the binding 100 may contact a heel bracket 500 that is disposed on the board B. The heel bracket may include one or more projections or planar areas for contacting the bottom of the binding 100 to protect and reduce wear on the board. Additionally, the heel bracket 500 may include one or more elevation assemblies 502. In the depicted embodiment, these are constructed of a folding member that can be disposed in a lower undeployed position or can be rotated to a raised deployed position to provide an elevated stop for the bottom of the binding 10 during use. An elevated stop can thus assist the user when traversing up an inclined surface in a ski or snowshoe type use of the board. The use of multiple elevation assemblies can allow for use in different inclines. As depicted, a sturdy tubular member that is bent into a suitable shape and resiliently passes into and out of locking recesses in the heel bracket 500 may be used to form the elevation assemblies.

Where a user desires to secure the heel of the binding 100 to the board B during ski mode use, a sliding heel lock assembly 600 may be used as depicted in the secured position in FIG. 6B. To release the heel lock, the assembly 600 is slid rearward to release the rails as depicted in FIG. 6A.

While this disclosure has been described using certain embodiments, it can be further modified while keeping within its spirit and scope. This application is therefore intended to cover any variations, uses, or adaptations of the disclosure using its general principles. For example, embodiments where the circular portion and bores are disposed on a structure attached to the binding other than the railings may be used. This application is intended to cover any and all such departures from the present disclosure as come within known or customary practices in the art to which it pertains, and which fall within the limits of the appended claims.

What is claimed is:

1. A splitboard binding system, comprising:

a binding including a base plate defining at least one planar portion for placement of a user's foot, the binding extending from a rear end to a forward end and comprising at least aligned two circular bores disposed near the forward end;

a toe bracket comprising at least two aligned pivot pins, configured such that the at least two circular bores on the binding may be disposed thereon simultaneously by a single sideways movement of the binding, and a securing lever pivotally disposed on an upper surface of the toe bracket, such that when the securing lever is rotated into a securing position, an end of the securing lever prevents removal of at least one pivot pin from the corresponding circular bore while allowing the binding to on the at least two pivot pins.

2. The splitboard binding system of claim 1, wherein the binding includes a left bottom rail and a right bottom rail which are attached to the bottom surface of the base plate and define a left channel and a right channel for slidable attachment to counterpart attachment structures disposed on a splitboard board in snowboard mode.

3. The splitboard binding system of claim 2, wherein with the at least two circular bores comprise a left circular bore disposed through a forward end of the left bottom rail and a right circular bore disposed through a forward end of the right bottom rail.

4. The splitboard binding system of claim 3, wherein the at least two aligned pivot pins comprise a left pivot pin and a right pivot pin that are axially coaligned.

5. The splitboard binding system of claim 2, further comprising a rear locking bracket for attachment to the splitboard, the rear locking bracket comprising at least one locking tab that may be slidably moved into a rear portion of the left channel or right channel to prevent the binding from pivoting upwards.

6. The splitboard binding system of claim 1, wherein the toe bracket further comprises a locking feature comprising a locking ridge on a lower portion of the toe bracket and a corresponding locking wall on the securing lever, such that when the securing lever is in the securing position, the locking ridge abuttably prevents rotation of the securing lever from the secured position.

7. The splitboard binding system of claim 6, wherein the locking ridge is adjacent an angled surface on a lower portion of the toe bracket, such that the corresponding locking wall on the securing lever flexes upwards as it is rotated towards the securing position, and then flexes downwards in the secured position.

8. The splitboard binding system of claim 6, wherein the securing lever must be flexed upwards to be rotated from the secured position.

9. The splitboard binding system of claim 8, wherein the securing lever is formed from a resilient material allowing it to flex along its length.

10. The splitboard binding system of claim 1, further comprising a sleeve lining each of the least two circular bores.

11. A binding system for a sport board, comprising:

a binding including a base plate extending from a rear end to a forward end and at least two circular bores disposed near the forward end, the at least two circular bores aligned with one another with the bores disposed to extend in a direction generally orthogonal to the rear to front direction of the binding;

a toe bracket comprising a base;

at least two pivot pins disposed on supports above the base, the at least two pivot pins aligned with one another and extending in a common direction; and a securing lever pivotally disposed on the base, the securing lever including a handle portion and a locking end, such that when the handle portion is rotated into a securing position, the locking end is placed adjacent an end of one of the at least to least two pivot pins.

12. The binding system of claim 11, wherein the binding includes a left bottom rail and a right bottom rail which are attached to the bottom surface of the base plate and define a left channel and a right channel for slidable attachment to counterpart attachment structures disposed on a sport board in snowboard mode.

13. The binding system of claim 12, wherein with the at least two circular bores comprise a left circular bore disposed through a forward end of the left bottom rail and a right circular bore disposed through a forward end of the right bottom rail.

14. The binding system of claim 13, further comprising a bushing layer disposed on each of the left bottom rail and right bottom rail around the respective circular bores and facing the direction of the supports for the at least two pivot pins such that bushing layers reside between the rails and the supports when the at least two pivot pins are inserted in the at least two circular bores.

15. The binding system of claim 11, further comprising a sleeve lining each of the least two circular bores.

16. The binding system of claim 11, wherein the toe bracket further comprises a locking feature comprising a locking ridge on the base and a corresponding locking wall on the handle portion of the securing lever, such that when the securing lever is in the securing position, the locking ridge abuttably prevents rotation of the securing lever from the secured position.

17. The binding system of claim 16, wherein the handle portion of the securing lever must be flexed upwards to be rotated over the locking ridge and flexed downwards to reside in the secured position.

18. The binding system of claim 17, wherein the base of the toe bracket further comprises an angled surface disposed such that the handle portion of the securing lever flexes upwards as it is rotated towards the securing position and passes over the angled surface towards the locking ridge.

19. The binding system of claim 17, wherein the handle portion of the securing lever is formed from a resilient material allowing it to flex along its length.

20. The binding system of claim 11, wherein at least two pivot pins extend from their respective supports to their distal ends in a rightward direction with respect to the binding.

21. The binding system of claim 20, wherein the locking end is placed adjacent the distal end of the left most pivot pin of the at least two pivot pins.

* * * * *